US009013462B2

(12) United States Patent
Kimoto

(10) Patent No.: US 9,013,462 B2
(45) Date of Patent: Apr. 21, 2015

(54) IMAGE DISPLAY DEVICE

(75) Inventor: Takayuki Kimoto, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 199 days.

(21) Appl. No.: 13/600,227

(22) Filed: Aug. 31, 2012

(65) Prior Publication Data

US 2013/0050170 A1 Feb. 28, 2013

(30) Foreign Application Priority Data

Aug. 31, 2011 (JP) ..... 2011-189782
Jun. 21, 2012 (JP) ..... 2012-139948

(51) Int. Cl.
*G09G 5/00* (2006.01)
*G09G 3/00* (2006.01)
*G09G 3/36* (2006.01)

(52) U.S. Cl.
CPC ..... *G09G 3/003* (2013.01); *G09G 3/3648* (2013.01); *G09G 2320/0252* (2013.01); *G09G 2320/0285* (2013.01); *G09G 2320/0613* (2013.01); *G09G 2340/16* (2013.01)

(58) Field of Classification Search
None
See application file for complete search history.

(56) References Cited

U.S. PATENT DOCUMENTS

| | | | | |
|---|---|---|---|---|
| 6,983,135 | B1 * | 1/2006 | Tsai et al. | 455/234.1 |
| 2006/0227249 | A1 * | 10/2006 | Chen et al. | 348/631 |
| 2007/0046597 | A1 * | 3/2007 | Park et al. | 345/87 |
| 2009/0109155 | A1 * | 4/2009 | Baba et al. | 345/88 |
| 2012/0001951 | A1 * | 1/2012 | Katagawa | 345/690 |
| 2012/0050280 | A1 * | 3/2012 | Kim | 345/419 |

FOREIGN PATENT DOCUMENTS

| | | | |
|---|---|---|---|
| JP | H06-189232 | A | 7/1994 |
| JP | 2007-199418 | A | 8/2007 |

* cited by examiner

*Primary Examiner* — William Boddie
*Assistant Examiner* — Bipin Gyawali
(74) *Attorney, Agent, or Firm* — James W. Judge

(57) ABSTRACT

An image display device 1 includes: a liquid crystal panel 11 having a plurality of pixels; and an overdrive execution section 50 configured to determine, with respect to each of target pixels for which overdrive is performed among the plurality of pixels of the liquid crystal panel 11, a gain usage value to be used for the overdrive, based on a predetermined set gain value, and to apply, based on the gain usage value, a liquid-crystal driving voltage to the corresponding target pixel, wherein with respect to a pixel, among the target pixels, for which it is judged that a gradation value in a current frame obtained from the video signal is an intermediate gradation value, the overdrive execution section 50 performs a gain suppressing operation for determining the gain usage value as a value smaller than the set gain value.

18 Claims, 5 Drawing Sheets

Fig. 2

| | GAIN ADJUSTMENT COEFFICIENT =1.0 | GAIN ADJUSTMENT COEFFICIENT =0.5 |
|---|---|---|
| VIDEO MODE | CINEMA MODE | DYNAMIC MODE |
| INPUT SIGNAL | HDMI, COMPOSITE VIDEO, COMPONENT | PC |
| CINEMA DETECTION | 24p | 50p, 60p, 50i, 60i |
| 2D／3D | 2D(TWO DIMENSIONAL) | 3D(THREE DIMENSIONAL) |

(a)

| GRADATION VALUE IN PRECEDING FRAME (INPUT LEVEL) | SET GAIN VALUE(a) | GAIN ADJUSTMENT COEFFICIENT | GAIN USAGE VALUE(b) |
|---|---|---|---|
| 0～63 | ×2 | ×1 | ×2 |
| 64～127 | ×2.5 | ×0.5 | ×1.25 |
| 128～191 | ×1.5 | ×1 | ×1.5 |
| 192～255 | ×1.2 | ×1 | ×1.2 |

(b)

IMAGE DISPLAY DEVICE

BACKGROUND

1. Field

The present disclosure relates to image display devices provided with a liquid crystal panel.

2. Description of the Related Art

Widespread among projectors, television receivers, and similar image display devices are image display devices provided with a liquid crystal panel. However, since liquid crystals are of low-level responsiveness, the moving-picture display properties of such image display devices are not high-level. For example, problems such as occurrence of after-images arise in such image display devices. In order to solve such problems, overdrive has been proposed, in which with respect to a pixel whose gradation value in the current frame to be displayed has changed from the gradation value of its immediately preceding frame, a voltage having a change amount greater than that of the voltage corresponding to the gradation value in the current frame (for example, see Japanese Patent No. 2616652 (Japanese Laid-Open Patent Publication No. H6-189232)).

SUMMARY

The present disclosure makes available an image display device, provided with a liquid crystal panel, capable of suppressing occurrence of false contours associated with overdrive.

An image display device according to the present disclosure is directed to An image display device configured to display an image based on a video signal, the image display device including: a liquid crystal panel having a plurality of pixels; and an overdrive execution section configured to determine, with respect to each of target pixels for which overdrive is performed among the plurality of pixels of the liquid crystal panel, a gain usage value to be used for the overdrive, based on a predetermined set gain value, and configured to apply, based on the gain usage value, a liquid-crystal driving voltage to the corresponding target pixel, wherein with respect to a pixel, among the target pixels, for which it is judged that a gradation value in a current frame obtained from the video signal is an intermediate gradation value, the overdrive execution section performs a gain suppressing operation for determining the gain usage value as a value smaller than the set gain value.

A storage medium having stored therein a program according to the present disclosure causes an image display device, provided with a liquid crystal panel having a plurality of pixels and configured to display video on the liquid crystal panel based on a video signal, to perform steps including: a set value obtaining step of obtaining, with respect to each of target pixels for which overdrive is performed among the plurality of pixels of the liquid crystal panel, a predetermined set gain value; and a usage value determination step of determining, with respect to each of the target pixels, a gain usage value to be used for determining, based on the set gain value, a liquid-crystal driving voltage to be applied to the corresponding target pixel, wherein in the usage value determination step, with respect to a pixel, among the target pixels, for which it is judged that a gradation value in a current frame obtained from the video signal is an intermediate gradation value, the gain usage value is determined as a value smaller than the set gain value.

An image display device according to the present disclosure is effective for suppressing occurrence of false contours associated with overdrive.

BRIEF DESCRIPTION OF THE DRAWINGS

FIG. 2 shows a data structure of gain information stored in a gain information storage section of the image display device according to the first embodiment;

DETAILED DESCRIPTION

Hereinafter, embodiments will be described in detail with reference to the drawings as appropriate. However, there will instances in which description more detailed than necessary is omitted. For example, there will be instances in which detailed description of already well known matters or description of substantially identical configurations is omitted. This is intended to avoid redundancy in the description below and to facilitate understanding by those skilled in the art.

It should be noted that the inventor provides the attached drawings and the following description so that those skilled in the art can fully understand this disclosure. Therefore, the drawings and description are not intended to limit the subject defined by the claims.

First Embodiment

[1-1. Configuration]

Figure 1:
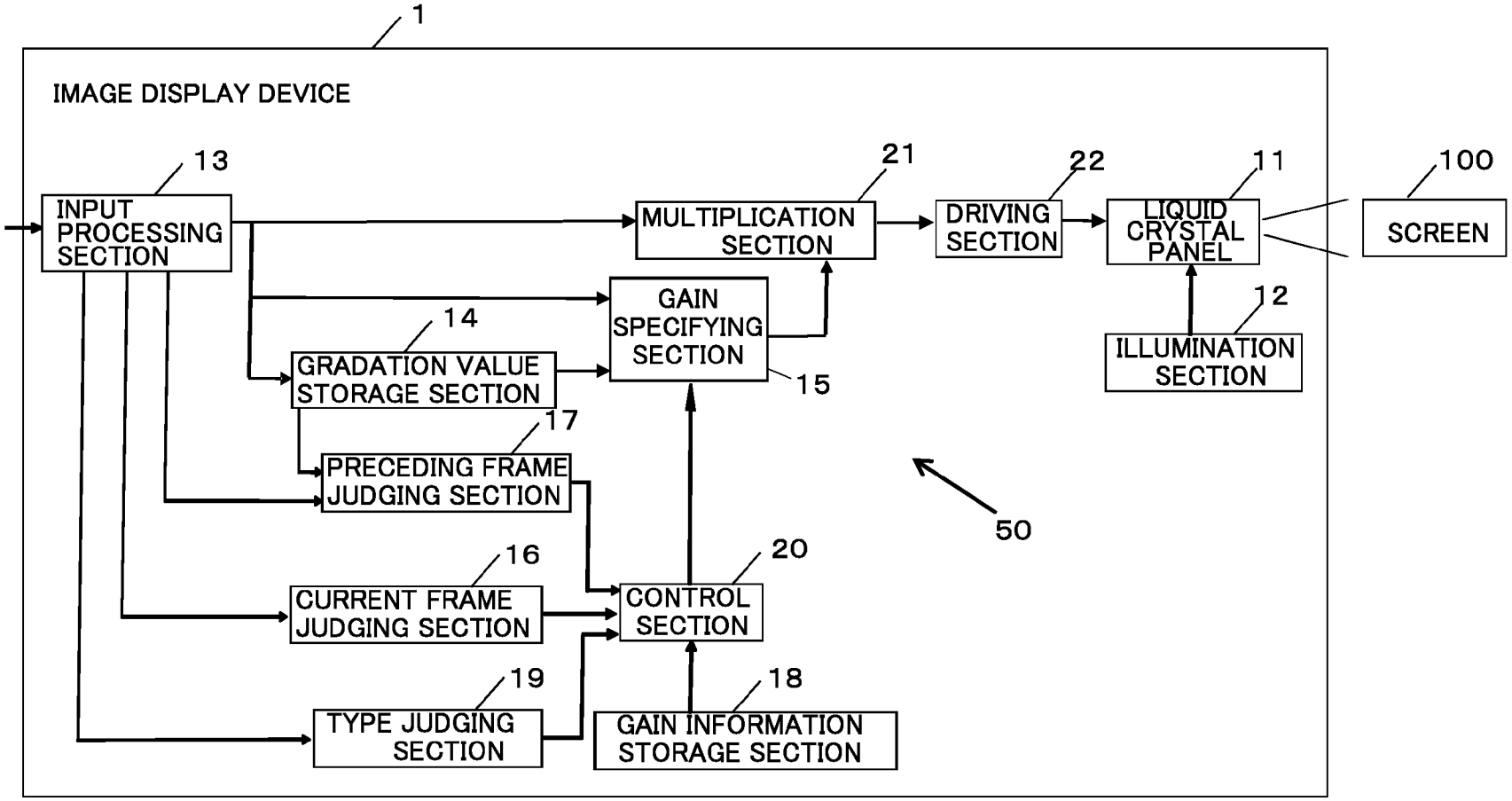
FIG. 1 is a block diagram of an image display device according to a first embodiment.

First, a configuration of an image display device 1 according to the present embodiment will be described. FIG. 1 is a block diagram of the image display device 1 according to the present embodiment. As shown in FIG. 1, the image display device 1 is a projector that projects video on a screen 100. The image display device 1 includes a liquid crystal panel 11, an illumination section 12, an input processing section 13, a gradation value storage section 14, a gain specifying section 15, a current frame judging section 16, a preceding frame judging section 17, a gain information storage section 18, a type judging section 19, a control section 20, a multiplication section 21, and a driving section 22. The gain specifying section 15, the current frame judging section 16, the preceding frame judging section 17, the gain information storage section 18, the control section 20, the multiplication section 21, and the driving section 22 form an overdrive execution section 50.

Although not shown, the liquid crystal panel 11 includes a pair of polarizing plates, a pair of glass substrates located between the pair of polarizing plates, and a liquid crystal layer located between the pair of glass substrates. One of the glass substrates is provided with a plurality of scanning lines and a plurality of data lines. The other of the glass substrates is provided with a common electrode. With this configuration, the liquid crystal panel 11 has a plurality of pixels which correspond to a plurality of intersections at which the plurality of scanning lines and the plurality of data lines cross each other. The plurality of scanning lines, the plurality of data lines, and the plurality of pixels are omitted in FIG. 1. A liquid crystal panel 11 is provided for each of RGB colors. For simpler description, only one of the liquid crystal panels 11 is shown and the other two liquid crystal panels 11 are omitted in FIG. 1.

The illumination section 12 splits white light into each of colors RGB, and emits the split lights to the respective liquid crystal panels 11 for RGB.

A video signal is inputted to the input processing section 13 from without. The input processing section 13 converts the inputted video signal into an RGB signal. In instances where the video signal is an HDMI input signal, for example, the input processing section 13 decodes the video signal and converts the resultant signal into an RGB signal. In instances where the video signal is a YPbPr component signal, for example, the input processing section 13 converts the video signal into an RGB signal, by performing matrix conversion. In instances where the video signal is a composite signal, for example, the input processing section 13 converts the video signal into an RGB component signal by performing video decoding.

The gradation value storage section 14 stores the gradation value of each of a plurality of pixels, among a plurality of frames formed based on the RGB signal obtained by the input processing section 13, in an immediately preceding frame (hereinafter, referred to as "preceding frame") of a current frame to be displayed (process-target frame). As described above, the plurality of pixels are included in the liquid crystal panel 11.

The gain specifying section 15 includes a look-up table (hereinafter, referred to as "LUT") configured as memory. The LUT stores a gain specifying table to be used during overdrive. By using the gain specifying table, with respect to each of the plurality of pixels of the liquid crystal panel 11, a predetermined set gain value is specified, based on a combination of a gradation value in the preceding frame and a gradation value in the current frame. Each set gain value is stored in the LUT, and a gradation value in the current frame and a gradation value in the preceding frame are used as parameters for reading it out. The set gain value is a value based on which a gain usage value to be used by the multiplication section 21 is determined. For example, the gain specifying table is a table that stores set gain values corresponding to all combinations of 64 gradation values in a preceding frame and 64 gradation values in a current frame, and that specifies the set gain values in 6-bit steps for the respective combinations.

In addition, with respect to each target pixel for which an overdrive execution condition is satisfied among the plurality of pixels of the liquid crystal panel 11, the gain specifying section 15 reads out, based on the gain specifying table, a set gain value in accordance with the combination of the gradation value in the preceding frame and the gradation value in the current frame, and specifies the set gain value. Further, by multiplying the specified set gain value by a rate (gain adjustment coefficient described later) in accordance with control operations by the control section 20, the gain specifying section 15 finally specifies a gain usage value to be used by the multiplication section 21. It should be noted that the gain specifying section 15 uses, as the gradation value in the preceding frame, a gradation value in the preceding frame stored in the gradation value storage section 14, and uses, as the gradation value in the current frame, a gradation value in the current frame based on the RGB signal obtained by the input processing section 13. The LUT is an example of memory used by the gain specifying section.

With respect to the target pixel for which the overdrive execution condition is satisfied among the plurality of pixels of the liquid crystal panel 11, the current frame judging section 16 (process-target-frame judging section) judges whether a first condition that the gradation value in the current frame is an intermediate gradation value is satisfied. The intermediate gradation value does not mean any gradation value that falls in a range from the second smallest gradation value to the second largest gradation value of all the gradation values, but means a gradation value that falls in a determined range included in said range. In the present embodiment, for example, the intermediate gradation value is a gradation value that falls in a range, when the gradation is divided into 256 levels, of gradation values being 30 or more and 128 or less. The current frame judging section 16 uses, as the gradation value in the current frame, a gradation value in the current frame based on the RGB signal obtained by the input processing section 13.

With respect to each of the plurality of pixels of the liquid crystal panel 11, the preceding frame judging section 17 judges whether the overdrive execution condition that the difference between the gradation value in the preceding frame and the gradation value in the current frame (hereinafter, referred to as "gradation value difference") is within a determined execution condition range is satisfied. The gradation value difference is the absolute value of the difference between the gradation value in the preceding frame and the gradation value in the current frame. Further, the execution condition range is a predetermined range (for example, a range of 0 or more and 20 or less).

Further, with respect to the target pixel for which the overdrive execution condition is satisfied among the plurality of pixels of the liquid crystal panel 11, the preceding frame judging section 17 judges whether a second condition that the gradation value in the preceding frame is an intermediate gradation value is satisfied. In addition, with respect to the target pixel for which the overdrive execution condition is satisfied among the plurality of pixels of the liquid crystal panel 11, the preceding frame judging section 17 judges whether a third condition that the gradation value difference is within a determined judging range is satisfied. The determined judging range is a range predetermined as a condition to judge whether to reduce the gain usage value to be used by the multiplication section 21. For example, in the case of 8-bit, 256 gradations, the determined judging range may be set to a range not exceeding "10" (that is, the range of 0 or more and 10 or less). It should be noted that the judging range is not limited to this numerical value range. Moreover, the judging range is a range narrower than the above execution condition range, and its entire range is included in the execution condition range. The preceding frame judging section 17 uses, as the gradation value in the preceding frame, a gradation value in the preceding frame stored in the gradation value storage section 14, and uses, as the gradation value in the current frame, a gradation value in the current frame based on the RGB signal obtained by the input processing section 13.

With respect to each of the types of video signals inputted into the input processing section 13, the gain information storage section 18 stores information for determining a gain usage value (hereinafter referred to as "gain information") to be used by the multiplication section 21. Specifically, the gain information storage section 18 stores gain information having the data structure shown in FIG. 2. FIG. 2 shows the data structure of the gain information stored in the gain information storage section 18 of the image display device 1 according to the present embodiment. In the gain information, for each of the plurality of video signal types, a gain adjustment coefficient by which a set gain value is multiplied is determined. The gain adjustment coefficient is a predetermined coefficient so as to be able to reduce the gain usage value when there is a possibility of a false contours occurring in association with the overdrive. The gain adjustment coefficient allows suppression of an increase in the liquid-crystal driving voltage during the gradation change from a low gradation to a high gradation, and suppression of a decrease in the liquid-crystal driving voltage during the gradation change from a high gradation to a low gradation.

In the present embodiment, the following is observed with reference to FIG. 2. (A-1) The gain adjustment coefficient when the video signal inputted to the input processing section 13 is a dynamic mode signal is 0.5. In this case, the gain usage value becomes 0.5 times the set gain value specified by the gain specifying table. (A-2) The gain adjustment coefficient when the video signal is a cinema mode signal is 1.0. In this case, the gain adjustment coefficient serves as gain information that specifies that the set gain value is not to be changed. (B-1) The gain adjustment coefficient when the video signal is a PC signal is 0.5. In this case, the gain usage value becomes 0.5 times the set gain value specified by the gain specifying table. (B-2) The gain adjustment coefficient when the video signal is an HDMI (High-Definition Multimedia Interface), composite video or component signal is 1.0. In this case, the gain adjustment coefficient serves as gain information that specifies that the set gain value is not to be changed.

(C-1) The gain adjustment coefficient when the video signal is a signal not corresponding to a cinema (for example, a 50p (progressive signal), 60p, 50i (interlace signal) or 60i signal) is 0.5. In this case, the gain usage value becomes 0.5 times the set gain value specified by the gain specifying table. (C-2) The gain adjustment coefficient when the video signal is a signal corresponding to a cinema (for example, a 24p signal) is 1.0. In this case, the gain adjustment coefficient serves as gain information that specifies that the set gain value is not to be changed. (D-1) The gain adjustment coefficient when the video signal is a three-dimensional stereoscopic video signal is 0.5. In this case, the gain usage value becomes 0.5 times the set gain value specified by the gain specifying table. (D-2) The gain adjustment coefficient when the video signal is a two dimensional video signal is 1.0. In this case, the gain adjustment coefficient serves as gain information that specifies that the set gain value is not to be changed.

As shown in FIG. 1, the type judging section 19 judges the type of the video signal inputted to the input processing section 13. For example, the type judging section 19 judges the type of the video signal inputted to the input processing section 13, by analyzing the header of a stream formed by the video signal inputted to the input processing section 13.

With respect to the target pixel, among the plurality of pixels of the liquid crystal panel 11, for which the overdrive execution condition is satisfied, the control section 20 controls the gain specifying section 15 so as to finally specify a gain usage value to be used by the multiplication section 21, based on results of the judgments performed by the current frame judging section 16, the preceding frame judging section 17, and the type judging section 19, and based on the gain information stored in the gain information storage section 18.

Specific functions of the control section 20 are as follows. With respect to each of the target pixels of the liquid crystal panel 11, in the case where the current frame judging section 16 has judged that the gradation value in the current frame is an intermediate gradation value, the preceding frame judging section 17 has judged that the gradation value in the preceding frame is an intermediate gradation value, and the preceding frame judging section 17 has judged that the gradation value difference is within the above-described judging range, the control section 20 performs a gain suppressing operation for reducing the predetermined set gain value. That is, with respect to each of the target pixels for which the first condition, the second condition, and the third condition are all satisfied, the control section 20 performs the gain suppressing operation. As the gain suppressing operation, the control section 20 controls the gain specifying section 15 such that a set gain value specified by the combination of the gradation value in the preceding frame and the gradation value in the current frame based on the gain specifying table is multiplied by a gain adjustment coefficient (gain rate) corresponding to the type of the video signal, determined by the type judging section 19, in the gain information stored in the gain information storage section 18.

For example, with respect to a target pixel of the liquid crystal panel 11, in the case where it is judged that the gradation value in the current frame is an intermediate gradation value, it is judged that the gradation value in the preceding frame is an intermediate gradation value, and it is judged that the gradation value difference is within the above-described judging range, if the type judging section 19 has judged that the video signal inputted to the input processing section 13 is a three-dimensional stereoscopic video signal, the control section 20 controls the gain specifying section 15 such that the set gain value specified by the combination of the gradation value in the preceding frame and the gradation value in the current frame is multiplied by the gain adjustment coefficient (0.5), in accordance with the gain information shown in FIG. 2. A gain usage value obtained by multiplying the set gain value by the gain adjustment coefficient is inputted to the multiplication section 21.

On the other hand, with respect to each of the target pixels of the liquid crystal panel 11, in the case where it is judged that the gradation value in the current frame is not an intermediate gradation value, it is judged that the gradation value in the preceding frame is not an intermediate gradation value, or it is judged that the gradation value difference is not within the above-described judging range, the control section 20 controls the gain specifying section 15 such that the set gain value itself specified by the combination of the gradation value in the preceding frame and the gradation value in the current frame based on the gain specifying table is outputted to the multiplication section 21. That is, with respect to a target pixel for which at least one of the first condition, the second condition, and the third condition is not satisfied, the control section 20 does not perform the gain suppressing operation but controls the gain specifying section 15 such that the set gain value is inputted, as the gain usage value, unaltered into the multiplication section 21.

The multiplication section 21 receives the RGB signal from the input processing section 13 and receives, from the gain specifying section 15, the gain usage value to be used in multiplication of the RGB signal. With respect to each of the target pixels of the liquid crystal panel 11, the multiplication section 21 multiplies the RGB signal received from the input processing section 13 by the gain usage value received from the gain specifying section 15, and thereby calculates a driving value to be used in a voltage applying process performed by the driving section 22. It should be noted that, with respect to a pixel for which overdrive is not performed, the multiplication section 21 determines a driving value to be used in the voltage applying process performed by the driving section 22, based on the RGB signal.

With respect to each of the plurality of pixels of the liquid crystal panel 11, the driving section 22 applies a voltage (liquid-crystal driving voltage), based on the driving value calculated by the multiplication section 21.

[1-2. Operations]

Figure 3:
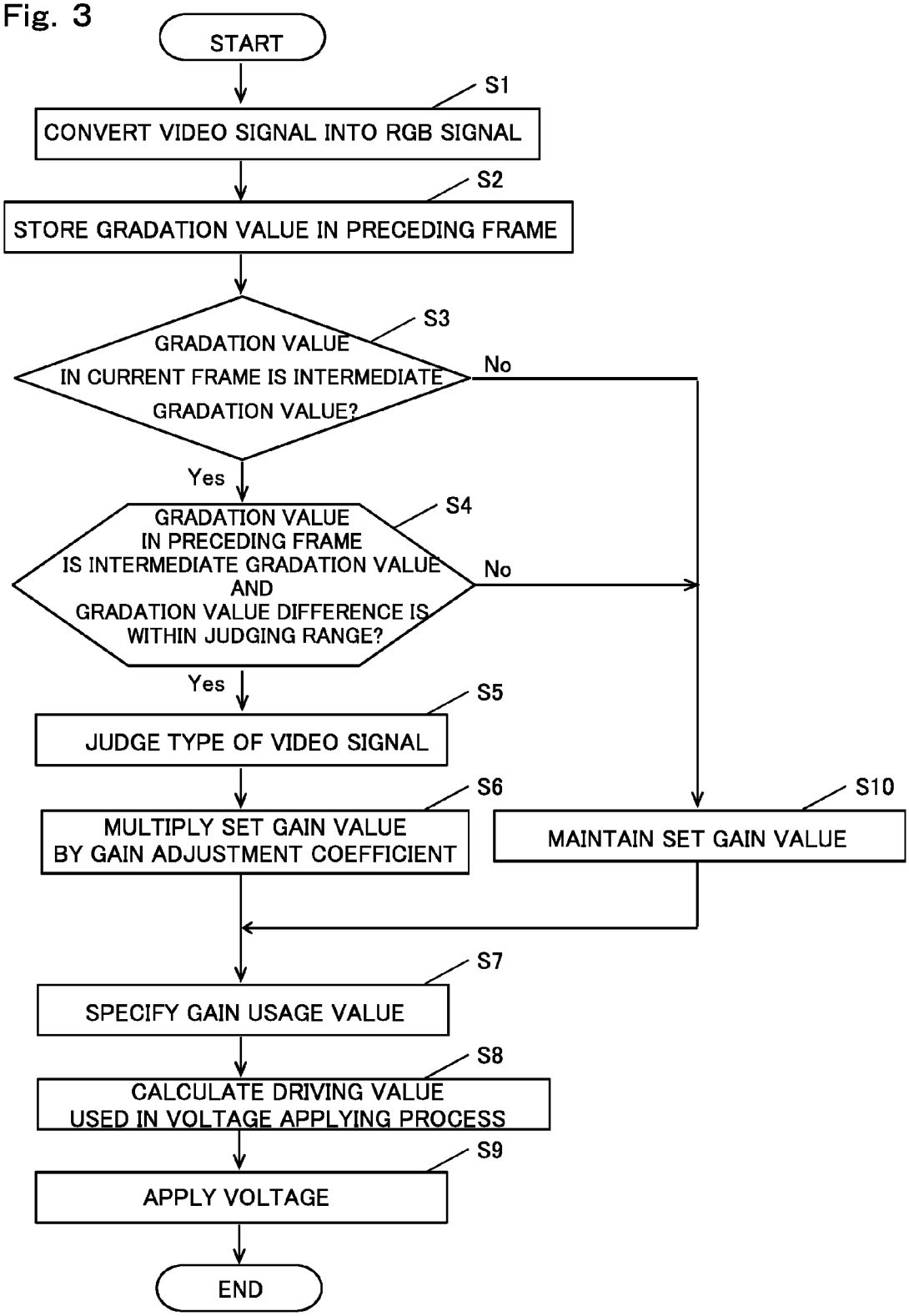
FIG. 3 is a flow chart showing steps of overdrive performed in the image display device according to the first embodiment.

Next, operations performed by the image display device 1 according to the present embodiment will be described. FIG. 3 is a flow chart showing steps of overdrive performed in the image display device 1 according to the present embodiment. It should be noted that the step of determining a target pixel for which the overdrive is to be performed is omitted in FIG. 3. This step is performed between, for example, step S2 and step S3.

First, a video signal is inputted to the input processing section 13, and the input processing section 13 converts the inputted video signal into an RGB signal (step S1). The gradation value storage section 14 stores the gradation value of each of a plurality of pixels in a frame, among a plurality of frames formed based on the RGB signal obtained by the input processing section 13, that immediately precedes the current frame (preceding frame) (step S2).

Subsequently, in step S3, it is judged whether the first condition is satisfied. Specifically, with respect to each of the target pixels of the liquid crystal panel 11, the current frame judging section 16 judges whether the gradation value in the current frame is an intermediate gradation value. In the case where the current frame judging section 16 has judged that the first condition is satisfied (Yes in step S3), it is judged, in step S4, whether the second condition and the third condition are satisfied. Specifically, with respect to each of the target pixels, the preceding frame judging section 17 judges whether the gradation value in the preceding frame is an intermediate gradation value, and judges whether the gradation value difference is within the above-described judging range.

With respect to each of the target pixels, in the case where the preceding frame judging section 17 has judged that both of the second condition and the third condition are satisfied (Yes in step S4), the type judging section 19 judges the type of the video signal inputted to the input processing section 13 (step S5).

Subsequently, the control section 20 controls the gain specifying section 15 so as to read out the set gain value specified by the combination of the gradation value in the preceding frame and the gradation value in the current frame based on the gain specifying table and to multiply the set gain value by the gain adjustment coefficient determined by the judgment in step S5 (step S6). Specifically, the control section 20 obtains a gain adjustment coefficient corresponding to the type of the video signal determined by the judgment in step S5, from the gain information storage section 18. Then, the control section 20 outputs the obtained gain adjustment coefficient to the gain specifying section 15, and controls the gain specifying section 15 so as to multiply the set gain value by the gain adjustment coefficient.

In step S7, a gain usage value is specified. In the case where the process advances from step S6 to step S7, with respect to each of the target pixels of the liquid crystal panel 11, as the gain usage value to be used by the multiplication section 21, the gain specifying section 15 specifies, in accordance with control operations by the control section 20, a value obtained by multiplying the set gain value specified by the combination of the gradation value in the preceding frame and the gradation value in the current frame based on the gain specifying table included in the gain specifying section 15, by the gain adjustment coefficient (gain rate) that, from the gain information stored in the gain information storage section 18, corresponds to the type of the video signal determined by the type judging section 19 (step S7).

The multiplication section 21 receives the RGB signal from the input processing section 13 and receives the gain usage value from the gain specifying section 15. Then, with respect to each of the target pixels of the liquid crystal panel 11, the multiplication section 21 multiplies the RGB signal by the gain usage value, and thereby calculates a driving value to be used in the voltage applying process performed by the driving section 22 (step S8).

With respect to each of the target pixels of the liquid crystal panel 11, the driving section 22 applies a voltage based on the driving value calculated by the multiplication section 21 (step S9).

Meanwhile, with respect to each of the target pixels of the liquid crystal panel 11, in the case where the current frame judging section 16 has judged that the gradation value in the current frame is not an intermediate gradation value (No in step S3), the control section 20 controls the gain specifying section 15 so as to output, to the multiplication section 21, the set gain value itself specified by the combination of the gradation value in the preceding frame and the gradation value in the current frame, as the gain usage value (step S10). Thereafter, the process advances to step S7.

Similarly, with respect to each of the target pixels of the liquid crystal panel 11, also in a case where the preceding frame judging section 17 has judged that the gradation value in the preceding frame is not an intermediate gradation value or that the gradation value difference is not within the above-described judging range (No in step S4), the control section 20 controls the gain specifying section 15 so as to output, to the multiplication section 21, the set gain value itself specified by the combination of the gradation value in the preceding frame and the gradation value in the current frame, as the gain usage value (step S10). Thereafter, the process advances to step S7.

By a video image for the current frame being formed in the liquid crystal panel 11 through the voltage applying process performed by the driving section 22 and by the illumination section 12 illuminating the liquid crystal panel 11, the image display device 1 projects the video image on the screen 100, whereby one overdrive operation for displaying a video image of the current frame ends.

Figure 4:
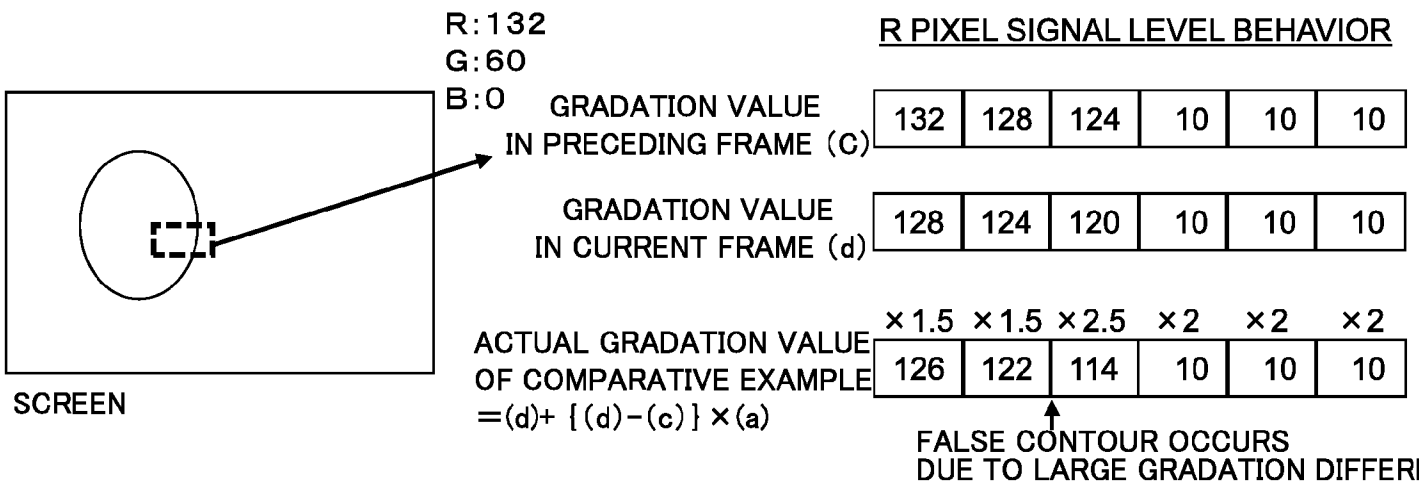
FIG. 4 illustrates the difference between the first embodiment in which a gain suppressing operation is performed, and a comparative example in which the gain suppressing operation is not performed.

Here, with reference to FIG. 4, the difference between the present embodiment in which the gain suppressing operation is performed, and a comparative example in which the gain suppressing operation is not performed will be described. FIG. 4(*a*) is a table indicating set gain values, gain adjustment coefficients, and gain usage values corresponding to four numerical value ranges of the gradation values (input levels) in preceding frames. In the above description of the present embodiment, a set gain value is specified by the combination of the gradation value in the preceding frame and the gradation value in the current frame. However, for simpler description, FIG. 4(*a*) is illustrated such that a set gain value is specified only by the gradation value in the preceding frame. In the comparative example, the set gain value is used unaltered, as a gain usage value. With reference to FIG. 4(*a*), the gain usage value in the second range in which the gradation value is 64 or more and 127 or less is smaller than the gain usage value in the first range in which the gradation value is 0 or more and 63 or less, and is smaller than the gain usage value in the third range in which the gradation value is 128 or more and 191 or less. However, the gain adjustment coefficients may be determined such that the gain usage values are determined in the descending order for the four numerical value ranges, or alternatively, for example, the gain adjustment coefficients may be determined such that the gain usage value in the second range is equal to the gain usage value in the third range.

On the other hand, from the top of FIG. 4(*b*), with respect to consecutive six R pixels surrounded by the dotted line in the screen, gradation values in the preceding frame (c), gradation values in the current frame (d), actual gradation values obtained by the overdrive in the comparative example (hereinafter, referred to as "actual gradation values of the comparative example"), and actual gradation values obtained by the overdrive in the present embodiment (hereinafter, referred to as "actual gradation values of the present embodiment") are shown in this order.

With respect to the second pixel from the left (hereinafter, referred to as "second pixel") and the third pixel from the left (hereinafter, referred to as "third pixel") in the actual gradation values of the comparative example, although the gradation value differences are the same, the difference between the actual gradation value of the second pixel (=122) and the actual gradation value of the third pixel (=114) is relatively large because the gain usage value (=set gain value) of the third pixel is too great compared to that of the second pixel. Therefore, a false contour has occurred at the boundary between the second pixel and the third pixel.

On the contrary, in the case of the present embodiment, with respect to the third pixel, the first condition that the gradation value (=120) in the current frame is an intermediate gradation value (a value that is 64 or more and 127 or less), the second condition that the gradation value (=124) in the preceding frame is an intermediate gradation value (a value that is 64 or more and 127 or less), and the third condition that the gradation value difference(=4) is within the judging range (a range of 0 or more and 10 or less) are all satisfied, and thus, the gain suppressing operation is performed. As a result, the gain usage value of the third pixel has become smaller than that of the comparative example, and the difference between the actual gradation value of the second pixel (=122) and the actual gradation value of the third pixel (=119) has been reduced. Therefore, no false contour has occurred at the boundary between the second pixel and the third pixel.

<Effects>

As described above, according to the present embodiment, it is possible to suppress occurrence of false contours associated with the overdrive.

Here, in the case where an image display device that performs overdrive uses an LUT for specifying a set gain value to be used in the overdrive, there may be a case where simplification of elements forming the image display device is required and thus a memory having a large capacity cannot be used for the LUT. That is, there may be a case where the number of division of the gain specifying table in the LUT is small and the number of steps provided for the set gain values is small. In such a case, if overdrive is performed without performing a gain suppressing operation, there is a high possibility that false contours occur in the displayed image. In particular, in a pixel having an intermediate gradation value in the current frame, a change in gains becomes more obvious, which results in a high possibility of a false contour being observed.

On the contrary, as described above, with respect to each of the target pixels of the liquid crystal panel 11, in the case where the gradation values of the two temporally consecutive frames are both intermediate gradation values and the gradation value difference therebetween is within the above-described judging range, the image display device 1 according to the present embodiment performs the overdrive by using a gain usage value for which the corresponding set gain value specified by the combination of the gradation values of the two frames is reduced. Accordingly, even if a memory having a large capacity cannot be used for the LUT, the image display device 1 according to the present embodiment can suppress occurrence of a large change in an intermediate gradation value caused by too large a gain usage value. As a result, even in the case where the capacity of the memory is restricted, the image display device 1 according to the present embodiment can provide an excellent effect that false contours caused by performing the overdrive are less likely to occur.

In particular, in the case where the signal inputted to the input processing section 13 is a three-dimensional stereoscopic video signal, the frame frequency is high. Accordingly, when compared with a memory having the same capacity, false contours are more likely to occur in the case of the three-dimensional stereoscopic video signal than in the case of a two-dimensional video signal. Meanwhile, in an image display device that processes a three-dimensional stereoscopic video signal, its processing capacity is centralized in components that correspond to the high frame frequency. Therefore, it is conceivable that a memory having a large capacity is not used for the LUT in order to simplify the configuration of the image display device. Also in such a case, when a three-dimensional stereoscopic video signal is processed, the present embodiment can more noticeably provide the effect that a false contours caused by performing the overdrive are less likely to occur.

Second Embodiment

[2-1. Configuration]

The present embodiment will be described. In the following, description of substantially the same configuration as that of the first embodiment may be omitted.

Similarly to the first embodiment, the image display device 1 according to the present embodiment includes the liquid crystal panel 11, the illumination section 12, the input processing section 13, the gradation value storage section 14, the gain specifying section 15, the current frame judging section 16, the preceding frame judging section 17, the gain information storage section 18, the type judging section 19, the control section 20, the multiplication section 21, and the driving section 22. The gain specifying section 15, the current frame judging section 16, the preceding frame judging section 17, the gain information storage section 18, the control section 20, the multiplication section 21, and the driving section 22 form the overdrive execution section 50.

The liquid crystal panel 11 includes a plurality of pixels. The liquid crystal panel 11 is provided for each of the RGB colors. The illumination section 12 splits white light into RGB colors, and emits the split lights to the liquid crystal panels 11 corresponding to the RGB colors, respectively. The input processing section 13 converts the inputted video signal into an RGB signal. The gradation value storage section 14 stores the gradation value of each of a plurality of pixels in a preceding frame. The gain specifying section 15 includes an LUT storing a gain specifying table.

With respect to each of the target pixels, of each liquid crystal panel 11, for which the overdrive execution condition is satisfied, the current frame judging section 16 judges whether the first condition that the gradation value in the current frame is an intermediate gradation value is satisfied. On the other hand, with respect to each of the target pixels, the preceding frame judging section 17 judges whether the third condition that the gradation value difference is within a determined judging range is satisfied. The preceding frame judging section 17 according to the present embodiment does not judge whether the second condition is satisfied.

The gain information storage section 18 stores the gain information shown in FIG. 2. The type judging section 19 judges the type of the video signal inputted to the input processing section 13. The control section 20 controls the gain specifying section 15 so as to finally specify a gain usage value to be used by the multiplication section 21, based on results of the judgments performed by the current frame judging section 16, the preceding frame judging section 17, and the type judging section 19, and based on the gain information.

Specific functions of the control section 20 are as follows. In the case where both of the first condition and the third condition are satisfied, the control section 20 performs a gain suppressing operation. As the gain suppressing operation, the control section 20 controls the gain specifying section 15 such that a set gain value specified by the combination of the gradation value in the preceding frame and the gradation value in the current frame based on the gain specifying table is multiplied by a gain adjustment coefficient (gain rate) corresponding to the type of the video signal, in the gain information, determined by the type judging section 19. On the other hand, in the case where at least one of the first condition and the third condition is not satisfied, the control section 20 does not perform the gain suppressing operation, but controls the gain specifying section 15 such that the set gain value is inputted, as the gain usage value, unaltered into the multiplication section 21.

The multiplication section 21 receives the RGB signal from the input processing section 13. In addition, the multiplication section 21 receives the gain usage value from the gain specifying section 15. With respect to each of the target pixels, the multiplication section 21 multiplies the RGB signal by the gain usage value, and thereby calculates a driving value to be used in the voltage applying process performed by the driving section 22. With respect to each of the plurality of pixels of the liquid crystal panel 11, the driving section 22 applies a voltage based on the driving value calculated by the multiplication section 21.

[2-2. Operations]

Figure 5:
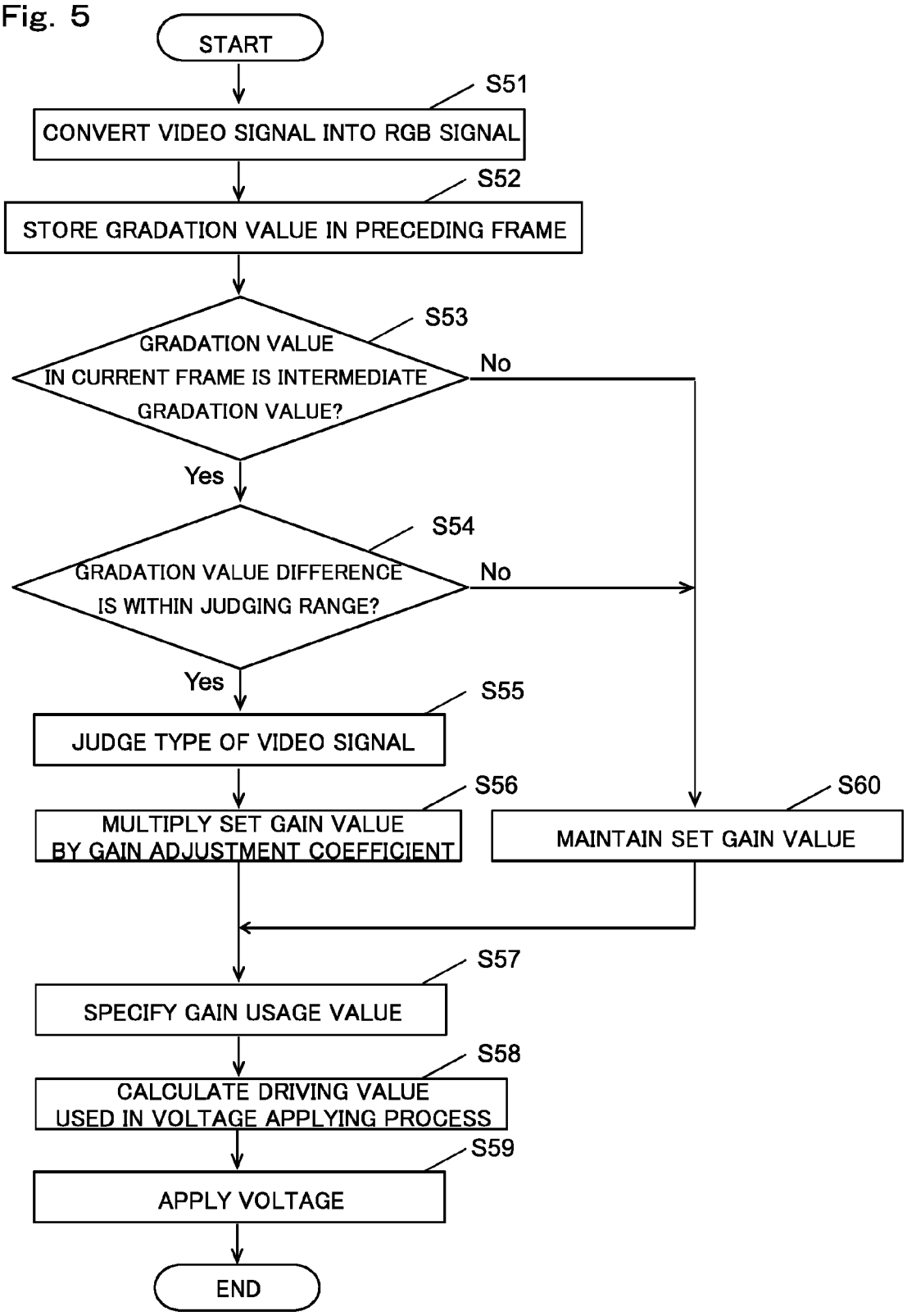
FIG. 5 is a flow chart showing steps of overdrive performed in an image display device according to a second embodiment.

Next, operations performed by the image display device 1 according to the present embodiment will be described. FIG. 5 is a flow chart showing steps of overdrive performed in the image display device 1 according to the present embodiment. It should be noted that, a step of determining a target pixel for which the overdrive is to be performed is omitted in FIG. 5 as in FIG. 3.

First, a video signal is inputted to the input processing section 13, and the input processing section 13 converts the inputted video signal into an RGB signal (step S51). The gradation value storage section 14 stores the gradation value of each of a plurality of pixels in a preceding frame, among a plurality of frames formed based on the RGB signal obtained by the input processing section 13 (step S52).

Subsequently, in step S53, with respect to each of the target pixels, it is judged whether the first condition is satisfied. In the case where the current frame judging section 16 has judged that the first condition is satisfied (Yes in step S53), it is judged whether the third condition is satisfied with respect to each of the target pixels, in step S54. With respect to each of the target pixels, in the case where the preceding frame judging section 17 has judged that the third condition is satisfied (Yes in step S54), the type judging section 19 judges the type of the video signal inputted to the input processing section 13 (step S55).

Subsequently, the control section 20 controls the gain specifying section 15 such that, with respect to each of the target pixels, a set gain value specified by the combination of the gradation value in the preceding frame and the gradation value in the current frame based on the gain specifying table is multiplied by a gain adjustment coefficient determined by the judgment in step S55 (step S56). Subsequently, a gain usage value is specified in step S57.

The multiplication section 21 receives the RGB signal from the input processing section 13 and receives the gain usage value from the gain specifying section 15. Then, with respect to each of the target pixels of the liquid crystal panel 11, the multiplication section 21 multiplies the RGB signal by the gain usage value, and thereby calculates a driving value to be used in the voltage applying process performed by the driving section 22 (step S58). With respect to each of the target pixels of the liquid crystal panel 11, the driving section 22 applies a voltage based on the driving value calculated by the multiplication section 21 (step S59).

On the other hand, in the case where it is judged that the first condition is not satisfied in step S53 (No in step S53), the control section 20 controls the gain specifying section 15 so as to output, to the multiplication section 21, the set gain value itself specified by the combination of the gradation value in the preceding frame and the gradation value in the current frame, as the gain usage value (step S60). Thereafter, the process advances to step S57.

Similarly, also in the case where it is judged that the third condition is not satisfied in step S54 (No in step S54), the control section 20 controls the gain specifying section 15 so as to output, to the multiplication section 21, the set gain value itself specified by the combination of the gradation value in the preceding frame and the gradation value in the current frame (step S60). Thereafter, the process advances to step S57.

By a video image for the current frame being formed in the liquid crystal panel 11 through the voltage applying process performed by the driving section 22 and by the illumination section 12 illuminating the liquid crystal panel 11, the image display device 1 projects the video image on the screen 100, whereby one overdrive operation for displaying a video image of the current frame ends.

<Effects>

As described above, according to the present embodiment, it is possible to suppress occurrence of false contours associated with the overdrive.

Other Embodiments

As described above, as an example of the technology disclosed in the present application, the first and second embodiments have been described. However, the technology in the present disclosure is not limited thereto, and is applicable to embodiments in which changes, replacements, additions, and omissions are performed appropriately. Further, a new embodiment can be made by combining the elements described in the first and second embodiments.

Hereinafter, other embodiments will be collectively described.

In the first and second embodiments, as an example of the overdrive execution section 50, the gain specifying section 15, the current frame judging section 16, the preceding frame judging section 17, the gain information storage section 18, the control section 20, the multiplication section 21, and the driving section 22 have been described. However, the overdrive execution section 50 is not limited thereto.

Further, in the first and second embodiments, the image display device 1 converts a video signal into an RGB signal. However, such signal conversion is not necessarily required. For example, in the case where an RGB signal is inputted to the image display device 1 from the outside, such signal conversion in the input processing section may be omitted.

Further, in the first and second embodiments, the coefficient by which the set gain value is multiplied in order to obtain a gain usage value is the gain adjustment coefficient alone. However, the gain usage value may be determined by multiplying the set gain value by a coefficient other than the gain adjustment coefficient. For example, irrespective of the gain suppressing operation, the set gain value may be multiplied by a coefficient that adjusts the differences among the individual film thicknesses of the liquid crystal panels 11. In this case, the gain usage value can be obtained by multiplying the set gain value by this coefficient and the gain adjustment coefficient.

Further, in the first and second embodiments, it is judged whether the gradation value difference is within a determined judging range. However, with respect to each of the target pixels, in the case where it is judged that the gradation values in the current frame and in the preceding frame are intermediate gradation values, even if the gradation value difference is not within the judging range, the control section 20 may control the gain specifying section 15 so as to reduce the gain usage value, by multiplying the set gain value specified by the combination of the gradation values in the two frames based on the gain specifying table by a gain adjustment coefficient (gain rate) corresponding to the type of the video signal, in the gain information, determined by the type judging section 19. Also in this case, it is possible to provide an excellent effect that false contours caused by performing the overdrive are less likely to occur.

Similarly, with respect to each of the target pixels, in the case where it is judged that the gradation values in the current frame is an intermediate gradation value, even if the gradation value in the preceding frame is not an intermediate gradation value, or even if the gradation value difference is not within the judging range, the control section 20 may control the gain specifying section 15 so as to reduce the gain usage value, by multiplying the set gain value specified by the combination of the gradation values in the two frames based on the gain specifying table by a gain adjustment coefficient (gain rate) corresponding to the type of the video signal, in the gain information, determined by the type judging section 19. Also in this case, it is possible to provide an excellent effect that false contours caused by performing the overdrive are less likely to occur.

Further, in the first and second embodiments, with respect to each of the target pixels, the control section 20 controls the gain specifying section 15 so as to reduce the gain usage value, by multiplying the set gain value specified by the gradation value combination of the gradation value in the current frame and the gradation value in the preceding frame based on the gain specifying table by a rate corresponding to the type of the video signal, in the gain information, determined by the type judging section 19. However, the control section 20 may control the gain specifying section 15 without using the gain information stored in the gain information storage section 18.

Specifically, with respect to each of the plurality of target pixels, when performing the gain suppressing operation, such as in the case where it is judged that the gradation value in the current frame is an intermediate gradation value, the control section 20 may control the gain specifying section 15 so as to reduce the gain usage value, by multiplying the set gain value specified by the gradation value combination of the gradation value in the current frame and the gradation value in the preceding frame based on the gain specifying table by a predetermined coefficient less than "1.0", such as "0.4". That is, irrespective of the type of the video signal, the same gain adjustment coefficient may be used. Also in such a case, it is possible to provide an excellent effect that false contours caused by performing the overdrive are less likely to occur.

Further, in the first and second embodiments, as an example of the gain specifying table included in the gain specifying section 15, a table composed of combinations of 64 gradation values in the preceding frame and 64 gradation values in the current frame is used. However, the gain specifying table included in the gain specifying section 15 is not limited to this table.

Further, in the first and second embodiments, an intermediate gradation value is a gradation value that falls in a range, when the gradation is divided into 256 levels, of gradation values being 30 or more and 128 or less. However, the intermediate gradation value may be a gradation value that falls in a range, when the gradation is divided into 256 levels, of gradation values being 30 or more and 80 or less. There was a case where, when an image display device performed the overdrive without performing the gain suppressing operation, a false contour was more noticeably observed in a frame, due to a pixel having a gradation value that falls in the range, when the gradation is divided into 256 levels, of gradation values being 30 or more and 80 or less. Therefore, if the intermediate gradation value is a gradation value that falls in the range, when the gradation is divided into 256 levels, of gradation values being 30 or more and 80 or less, even if a memory having a large capacity is used for the LUT, it is possible to suppress occurrence of a large change in the intermediate gradation value caused by too large a gain usage value. That is, it is possible to provide an excellent effect that false contours caused by performing the overdrive are less likely to occur.

Further, in the first and second embodiments, an intermediate gradation value is a gradation value that falls in the range, when the gradation is divided into 256 levels, of gradation values being 30 or more and 128 or less. This means that when the gradation is divided into 1024 levels, an intermediate gradation value is a gradation value that falls in a range of gradation values being 120 or more and 469 or less. Thus, the intermediate gradation value is a value that corresponds to each value that falls in the range, when the gradation is divided into 256 levels, of gradation values being 30 or more and 128 or less. Therefore, if it is assumed that the intermediate gradation value is a gradation value that falls in the range, when the gradation is divided into 256 levels, of gradation values being 30 or more and 80 or less, it means that the intermediate gradation value is a gradation value that falls in the range, when the gradation is divided into 1024 levels, of gradation values being 120 or more and 320 or less. In any case, the intermediate gradation value is not limited to a gradation value that falls in the range, when the gradation is divided into 256 levels, of gradation values being 30 or more and 128 or less.

Further, in the first and second embodiments, with respect to each of the target pixels, the preceding frame judging section 17 judges whether the gradation value difference is within a determined judging range, and as the judging range for the gradation value difference, a range not exceeding "10" of 8-bit, 256 gradations has been used as an example. However, the determined judging range may be determined as appropriate by performing tests. In essence, the determined judging range may be any range predetermined as a condition for reducing the gain usage value to be used by the multiplication section 21.

Further, in the first and second embodiments, in the case where the type of the video signal is a video signal listed on the left side of FIG. 2 (for example, a video signal in the cinema mode), the gain suppressing operation is performed with the gain adjustment coefficient set at 1.0. However, in such a case, it is possible not to perform the gain suppressing operation itself. That is, even if a condition for performing the gain suppressing operation, such as the gradation value of the target pixel in the current frame is an intermediate gradation value, is satisfied, if the type of the video signal determined by the type judging section is a determined video signal, it is possible for the overdrive execution section not to perform the gain suppressing operation.

Further in the first and second embodiments, as the gain information stored in the gain information storage section 18, the gain information provided in the data structure shown in FIG. 2 is used as an example. However, the gain adjustment coefficient in the gain information may be determined as appropriate by performing tests for each video signal type. For example, the gain adjustment coefficient may be 0.2 when the video signal is a three-dimensional stereoscopic video signal.

Further, in the first and second embodiments, the gain adjustment coefficient in the gain information stored in the gain information storage section 18 is specified for the type of each video signal inputted to the input processing section 13. However, the gain adjustment coefficient may be determined in accordance with the gradation value of the target pixel in the current frame. In this case, according to the extent the gradation value in the current frame is located toward the lower gradation end in an intermediate gradation range, a reduction amount of the gain usage value corresponding to the set gain value may be increased. That is, according to the extent the gradation value in the current frame is located toward the lower gradation end, the gain adjustment coefficient may be decreased. For example, the gradation value of the target pixel in the current frame is a low gradation value, such as 40, when the gradation is divided into 256 levels, the gain adjustment coefficient may be 0.3.

Further, in the first and second embodiments, the image display device 1 is a projector that projects video on the screen 100 as shown in FIG. 1. However, the image display device according to the present disclosure is not limited to a projector. The image display device according to the present disclosure may be a display device or the like connected to a television receiver or a PC. In such a case, RGB pixels may be provided in one liquid crystal panel. One pixel unit is formed by an R pixel, a G pixel, and a B pixel. The image display device according to the present disclosure is an image display device in which liquid crystals are used.

Among the steps of the overdrive performed by the image display device 1 as described in the first and second embodiments, the set value obtaining step of obtaining, with respect to a target pixel for which the overdrive execution condition is satisfied, a predetermined set gain value, and the usage value determination step of determining, with respect to the target pixel, a gain usage value to be used in determination of a liquid-crystal driving voltage to be applied to the target pixel, based on the set gain value, may be realized by determined program data stored in a storage device (ROM, RAM, hard disk, etc.) being interpreted and executed by the CPU. In the usage value determination step, with respect to a pixel, among the target pixels, for which it is judged that the gradation value in the current frame obtained from the video signal is an intermediate gradation value, the gain usage value is determined as a value smaller than the set gain value. At this time, the program data may be loaded to the storage device via a storage medium or may be directly executed on the storage medium. The storage medium includes: semiconductor memories, such as a ROM, a RAM, and a flash memory; magnetic disk memories such as a flexible disk, and a hard disk; optical disk memories such as a CD-ROM, a DVD, and a BD; memory cards; and the like. The storage medium is a notion including communication mediums such as telephone lines, carrier paths, and the like. The program data may be provided to the image display device 1 by, for example, being downloaded through a communication line.

As described above, embodiments have been described as examples of the technology in the present disclosure. Thus, the attached drawings and detailed description have been provided.

Therefore, in order to illustrate the technology, not only essential elements for solving the problems but also elements that are not necessary for solving the problems may be included in elements appearing in the attached drawings or in the detailed description. Therefore, such unnecessary elements should not be immediately determined as necessary elements because of their presence in the attached drawings or in the detailed description.

Further, since the embodiments described above are merely examples of the technology, it is understood that various modifications, replacements, additions, omissions, and the like can be performed in the scope of the claims or in an equivalent scope thereof.

What is claimed is:

1. An image display device configured to display an image based on a video signal, the image display device comprising:

a liquid crystal panel having a plurality of pixels; and an overdrive execution section configured to read out, with respect to each of target pixels for which overdrive is performed in a current frame obtained from the video signal, among the plurality of pixels of the liquid crystal panel, a set gain value stored in a table in accordance with a combination of a gradation value in the current frame and a gradation value in a preceding frame immediately before the current frame, configured to determine, with respect to each target pixel, a gain usage value to be used for the overdrive, based on the read-out set gain value, and configured to apply, based on the gain usage value, a liquid-crystal driving voltage to the corresponding target pixel, wherein with respect to a pixel, among the target pixels, for which it is judged that the gradation value in the current frame is an intermediate gradation value, the overdrive execution section performs a gain suppressing operation for determining the gain usage value as a value smaller than the set gain value, wherein the overdrive execution section determines the gain usage value by multiplying the set gain value by a predetermined gain adjustment coefficient.

2. The image display device according to claim 1, wherein with respect to a pixel, among the target pixels, for which it is judged that the gradation value in the current frame is an intermediate gradation value and that the difference between the gradation value in the current frame and a gradation value in the preceding frame is within a determined judging range, the overdrive execution section performs the gain suppressing operation.

3. The image display device according to claim 2, wherein an execution condition for the overdrive is a condition that the difference between the gradation value in the current frame and the gradation value in the preceding frame is within a determined range, and the judging range is a range that is included in the determined range for the execution condition and that is narrower than the determined range.

4. The image display device according to claim 1, wherein with respect to a pixel, among the target pixels, for which it is judged that the gradation value in the current frame is an intermediate gradation value, that a gradation value in the preceding frame is an intermediate gradation value, and that the difference between the gradation value in the current frame and the gradation value in the preceding frame is within a judging range, the overdrive execution section performs the gain suppressing operation.

5. The image display device according to claim 1, wherein with respect to a pixel, among the target pixels, for which it is judged that the gradation value in the current frame is an intermediate gradation value, and that a gradation value in the preceding frame is an intermediate gradation value, the overdrive execution section performs the gain suppressing operation.

6. The image display device according to claim 1, further comprising:

a type judging section configured to judge the type of the video signal, wherein in the gain suppressing operation, the overdrive execution section determines a reduction amount of the gain usage value corresponding to the set gain value, in accordance with the type of the video signal determined by the type judging section.

7. The image display device according to claim 6, wherein the overdrive execution section increases the reduction amount when the video signal is a three-dimensional video signal, compared with a case where the video signal is a two-dimensional video signal.

8. The image display device according to claim 1, further comprising:

a type judging section configured to judge the type of the video signal, wherein even when the gradation value, in the current frame, of each of the target pixels is an intermediate gradation value, if the type of the video signal determined by the type judging section is a determined video signal, the overdrive execution section does not perform the gain suppressing operation.

9. The image display device according to claim 1, wherein in the gain suppressing operation, according to the extent the gradation value in the current frame is located toward the lower gradation end in an intermediate gradation range, the overdrive execution section increases a reduction amount of the gain usage value corresponding to the set gain value.

10. The image display device according to claim 1, wherein the intermediate gradation value is a value, when the gradation is divided into 256 levels, that falls in a range of gradation values being 30 or more and 128 or less.

11. A non-transitory computer-readable storage medium having stored therein a program that causes an image display device, provided with a liquid crystal panel having a plurality of pixels and configured to display video on the liquid crystal panel based on a video signal, to perform steps comprising:

a set value obtaining step of reading out, with respect to each of target pixels for which overdrive is performed in a current frame obtained from the video signal, among the plurality of pixels of the liquid crystal panel, a set gain value stored in a table in accordance with a combination of a gradation value in the current frame and a gradation value in a preceding frame immediately before the current frame; and a usage value determination step of determining, with respect to each of the target pixels, a gain usage value to be used for determining, based on the read-out set gain value, a liquid-crystal driving voltage to be applied to the corresponding target pixel, wherein in the usage value determination step, with respect to a pixel, among the target pixels, for which it is judged that the gradation value in the current frame is an intermediate gradation value, the gain usage value is determined as a value smaller than the set gain value, wherein an overdrive execution section determines the gain usage value by multiplying the set gain value by a predetermined gain adjustment coefficient.

12. The image display device according to claim 1, wherein the overdrive execution section:

judges whether the gradation value in the current frame is the intermediate gradation value;

performs the gain suppressing operation, with respect to a pixels, among the target pixels, for which it is judged that the gradation value in the current frame is the intermediate gradation value; and does not perform the gain suppressing operation, with respect to a pixels, among the target pixels, for which it is judged that the gradation value in the current frame is not the intermediate gradation value.

13. The image display device according to claim 1, further comprising a gradation value storage section storing the gradation value in the preceding frame; wherein:

the overdrive execution section reads out the set gain value, with respect to the target pixels, in accordance with the combination of the gradation value in the current frame obtained from the video signal and the gradation value in preceding frame stored by the gradation value storage section.

14. The image display device according to claim 1, wherein the intermediate gradation value is a gradation value in a predetermined range that is within a part of a range from the second smallest gradation value to the second largest gradation value of all the gradation values.

15. The image display device according to claim 1, wherein the overdrive execution section calculates the liquid-crystal driving voltage by multiplying an RGB (Red Green and Blue) signal obtained from the video signal by the gain usage value.

16. The image display device according to claim 6, wherein the overdrive execution section increases the reduction amount when the video signal is a dynamic mode signal, compared with a case where the video signal is a cinema mode signal.

17. The image display device according to claim 6, wherein the overdrive execution section does not perform the gain suppressing operation when the video signal is not a Personal Computer (PC) signal even when the gradation value, in the current frame, of each of the target pixels is an intermediate gradation value.

18. The image display device according to claim 8, wherein the overdrive execution section does not perform the gain suppressing operation when the video signal is a 24 progressive scan signal as a progressive scan signal, even when the gradation value, in the current frame, of each of the target pixels is an intermediate gradation value.

* * * * *